US009730539B2

(12) United States Patent
Bolland

(10) Patent No.: US 9,730,539 B2
(45) Date of Patent: Aug. 15, 2017

(54) DOUBLE-BARRELED BEVERAGE CONTAINER

(71) Applicant: Two Fisted Drinker, LLC, Mesa, AZ (US)

(72) Inventor: Michael J. Bolland, Mesa, AZ (US)

(73) Assignee: Two Fisted Drinker, LLC, Mesa, AZ (US)

( * ) Notice: Subject to any disclaimer, the term of this patent is extended or adjusted under 35 U.S.C. 154(b) by 0 days.

(21) Appl. No.: 15/213,985

(22) Filed: Jul. 19, 2016

(65) Prior Publication Data

US 2017/0042355 A1 Feb. 16, 2017

Related U.S. Application Data

(60) Provisional application No. 62/204,632, filed on Aug. 13, 2015.

(51) Int. Cl.
*A47G 19/22* (2006.01)

(52) U.S. Cl.
CPC ..... *A47G 19/2205* (2013.01); *A47G 19/22* (2013.01)

(58) Field of Classification Search
USPC ..... D7/513, 536, 523, 396.4, 516; 220/501, 220/504, 23.2; 215/6
See application file for complete search history.

(56) References Cited

U.S. PATENT DOCUMENTS 828,854 A * 8/1906 Kideney ..... A24F 19/06 220/501
1,496,989 A * 6/1924 Kideney ..... A45D 27/14 16/425
1,520,402 A * 12/1924 Clemans ..... A47G 19/02 206/0.84
1,941,327 A * 12/1933 Turner ..... A47G 19/2266 215/6
D123,103 S * 10/1940 Murray ..... D9/740
D206,943 S * 2/1967 Kinney ..... D7/513
3,400,855 A * 9/1968 Alexander ..... A47G 19/2211 215/6
D218,350 S * 8/1970 Marks ..... D7/513
D258,796 S * 4/1981 Paulides ..... D7/513
D261,465 S * 10/1981 Minchew ..... D30/130
D292,157 S * 10/1987 Robinson ..... D7/505
(Continued)

*Primary Examiner* — J. Gregory Pickett
*Assistant Examiner* — Gideon Weinerth
(74) *Attorney, Agent, or Firm* — Schmeiser, Olsen & Watts, LLP

(57) ABSTRACT

A double-barreled beverage container is described. The container includes two mugs, glasses, or similar-shaped drinking containers joined together alongside one-another, with at least one hole at or near the bottom of the glasses passing between the two drinking containers at the junction. In this way, as a person drinking from one of glass of the beverage container tips the container upward, a beverage flows from the uppermost glass through the hole into the lower glass from which the person drinks. The double-barreled beverage container employs a whimsical but functional device for party or other use reminiscent of a "two-fisted drinking" activity, wherein a person holds a glass or mug in each hand and alternates drinking from each container. The double-barreled beverage container enables one who wishes to drink from two glasses at once to drink from a single device.

20 Claims, 8 Drawing Sheets

(56) References Cited

U.S. PATENT DOCUMENTS

| | | | | | |
|---|---|---|---|---|---|
| 5,370,258 | A | * | 12/1994 | Fair | B65D 25/02 220/501 |
| 5,405,030 | A | * | 4/1995 | Frazier | A47G 19/2205 215/6 |
| D371,720 | S | * | 7/1996 | Hung | D7/503 |
| D436,803 | S | * | 1/2001 | Addison | D7/509 |
| D439,802 | S | * | 4/2001 | Colmore | D7/511 |
| D462,239 | S | * | 9/2002 | Schibuola | D7/534 |
| D472,426 | S | * | 4/2003 | Premji | D7/513 |
| D556,510 | S | * | 12/2007 | Meuser | D7/513 |
| D557,985 | S | * | 12/2007 | Arcangeli | D7/509 |
| D583,193 | S | * | 12/2008 | Kushner | D7/505 |
| 7,946,445 | B2 | * | 5/2011 | Tytar | B01D 35/30 220/501 |
| 8,272,506 | B1 | * | 9/2012 | Flannery | A47G 23/02 206/217 |
| D680,375 | S | * | 4/2013 | Pousard | D7/513 |
| D714,588 | S | * | 10/2014 | Cummings | D7/509 |
| D744,779 | S | * | 12/2015 | Bolland | D7/396.4 |
| D746,109 | S | * | 12/2015 | Wilson | D7/534 |
| 2007/0108215 | A1 | * | 5/2007 | Wilson | A47G 19/2205 220/719 |
| 2008/0217280 | A1 | * | 9/2008 | Dekker | A23L 2/52 215/6 |
| 2017/0042355 | A1 | * | 2/2017 | Bolland | A47G 19/2205 |

* cited by examiner

DOUBLE-BARRELED BEVERAGE CONTAINER

CROSS REFERENCE TO RELATED APPLICATION

This application claims priority from U.S. Patent Application No. 62/204,632, filed Aug. 13, 2015 and entitled "Double-Barreled Beverage Container," which is incorporated entirely herein by reference.

BACKGROUND OF THE INVENTION

Technical Field

This invention relates to drinking containers for holding refreshments. In particular, the invention relates to a double-barreled beverage container.

State of the Art

Simple containers for drinking are ubiquitous personal articles in all societies. Drinking containers are used many times daily by essentially all persons. Traditional drinking containers, however, have a simple design and limited capacity which has changed relatively little throughout Western societies over the last five hundred years. An example of a drinking container of traditional design is a water glass. It is desirable, in many situations, that a water glass hold as much liquid as possible. This is accomplished be increasing the size dimensions of the glass, so as to increase the volume of liquid which can be held by the glass. A larger glass has a larger capacity.

Increasing a glass's capacity, however, creates problems for a user of the glass. First, a large-diameter glass is more difficult to hold, particularly by someone with relatively small hands. Second, when a large glass is filled to its capacity, it is heavier, possibly much heavier, than a smaller glass. A large glass with the capacity to hold a relatively large volume of liquid, therefore, is simultaneously more awkward to hold in the user's hand and heavier than a smaller glass with a smaller capacity. This situation increases user discomfort, fatigue, and additionally increases the risk of spillage, dropping the glass, and the like.

Accordingly, what is needed is a drinking container with a substantially increased capacity over many drinking containers found in the prior art which is simultaneously 1) more comfortable to hold; and 2) easier to hold securely with less hand strength when filled to or near to its capacity.

SUMMARY OF EMBODIMENTS

Disclosed is a double-barreled beverage container comprising a first glass; a second glass; a bridge coupled to the first glass and the second glass; and a flow hole, wherein the flow hole communicates with the first glass and the second glass. Embodiments of the invention include two drinking containers coupled together with interior volumes remaining in fluid continuity with one another, about twice the volume of a liquid comestible may be consumed from the invention as with a similar-sized conventional drinking glass or other drinking container.

Disclosed is a double-barreled beverage container comprising a first glass comprising a first interior volume bounded by a first side, a first closed end, and an open first open end; a second glass comprising a second interior volume bounded by a second side, a closed second closed end, and an open second open end; and a bridge coupled between the first side and the second side and comprising a flow hole, wherein the flow hole fluidly comprises the first interior volume and the second interior volume.

In some embodiments, the double-barreled beverage container further comprises a handle coupled to the bridge. In some embodiments, the double-barreled beverage container further comprises a second handle coupled to the bridge opposite the first handle. In some embodiments, the double-barreled beverage container further comprises a handle coupled to the first side. In some embodiments, the double-barreled beverage container further comprises a handle coupled to the second side. In some embodiments, the double-barreled beverage container further comprises a handle coupled to the first side and a handle coupled to the second side. In some embodiments, the double-barreled beverage container further comprises a base coupled to the closed first end and the closed second end. In some embodiments, the double-barreled beverage container comprises a plurality of flow holes.

Disclosed is a method of forming a double-barreled beverage container comprising the steps of providing a first drinking glass comprising a first interior volume which fluidly communicates with a first hole in a first side and a second drinking glass comprising a second interior volume which fluidly communicates with a second hole in a second side; interposing a bridge comprising a third hole between the first glass and the second glass; aligning the third hole with the first hole and the second hole to form a flow hole, wherein the first interior volume fluidly communicates with the second interior volume through the flow hole; and coupling the bridge between the first drinking glass the and second drinking glass to form a double-barreled beverage container.

In some embodiments, the method further comprises coupling a handle to the double-barreled beverage container. In some embodiments, the method further comprises coupling a plurality of handles to the double-barreled beverage container. In some embodiments, the handle is coupled to the bridge. In some embodiments, the handle is coupled to the first drinking container. In some embodiments, a first handle is coupled to the bridge and a second handle is coupled to the bridge opposite the first handle. In some embodiments, the first handle is coupled to the first drinking container and a second handle is coupled to the second drinking container opposite the first handle. In some embodiments, the method further comprises coupling a base to the first drinking container and the second drinking container.

Disclosed is a method of using a double-barreled beverage container comprising the steps of filling the double-barreled beverage container with a liquid comestible; and tipping the double-barreled beverage container wherein gravity causes the liquid comestible to flow from a first glass into a second glass through a flow hole.

In some embodiments, the method further comprises a step grasping a handle of the double-barreled beverage container. In some embodiments, the method further comprises a step simultaneously grasping two handles of the double-barreled beverage container. In some embodiments, the liquid comestible comprises a yeast-fermented beverage.

DETAILED DESCRIPTION OF EMBODIMENTS OF THE INVENTION

As noted herein above, the present invention relates to a double-barreled beverage container. Specifically, the invention relates to drinking containers for comestible beverages which facilitate consumption of a relatively large volume of a comestible beverage from a single drinking container by a user. Embodiments of the invention include two drinking glass-type containers joined in a side-by-side configuration by a bridge. The bridge comprises at least one flow hole proximate to the bottom of each glass. Tipping of the glass causes the liquid, such as a comestible beverage, to flow from the upper glass to the lower glass from which a user drinks. Various embodiments of the invention enable the user to consume double the quantity of beverage possible versus use of a traditional glass or mug. Additionally, the invention may provide a whimsical but functional device for party or other use reminiscent of a "two-fisted drinking" activity, wherein a person holds a glass or mug in each hand and alternates drinking from each container. The invention, therefore, may enable one who wishes to alternate drinking from two glasses at once to drink from a single device.

Figure 1:
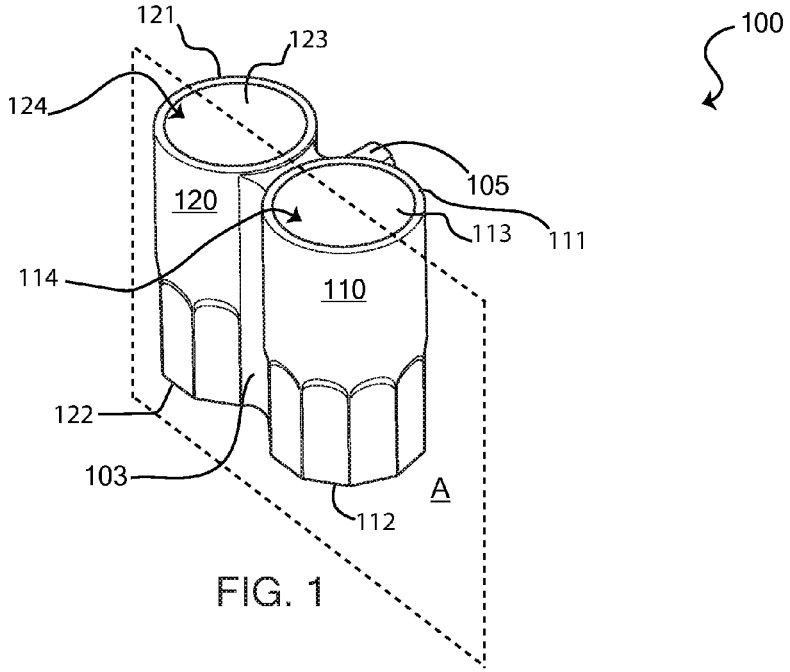
FIG. 1 is a perspective view of a double-barreled beverage container.

FIG. 1 is a perspective view of a double-barreled beverage container. FIG. 1 shows a double-barreled beverage container 100 comprising a first glass 110 and a second glass 120. First glass 110 and second glass 120 are substantially similar structures, in some embodiments. For example, first glass 110 and second glass 120 each comprise interior volumes defined by sides closed on one end and open on opposite ends. Although first and second glass 110 and 120 are referred to as "glasses", it is to be understood that first and second glass 110 and 120 can be formed of any rigid material such as glass or plastic, for example.

First glass 110 comprises a first side 111 coupled to a first closed end 112 defining a first interior volume 114. A first open end 113 communicates with the first interior volume 114, as shown in FIG. 1. Similarly, in some embodiments, second glass 120 comprises a second side 121 coupled to a second closed end 122 defining a second interior volume 124. A second open-end 123 communicates with the second interior volume 124.

In the embodiment shown in FIG. 1, and some other embodiments, first side 111 and second side 121 are generally cylindrical in shape. This is by way of example, and not meant to be limiting. First glass 110 and second glass 120 may be formed in a shape similar to any traditional or non-traditional drinking glass, cup, shot-glass, or mug shape. The general shape of first glass 110 and second glass 120 may be cylindrical, globular, spherical, polyhedral, tapered, regular, irregular, or the like. In some embodiments, first glass 110 and second glass 120 are shaped like figurines, animals, other creatures, or other similarly whimsical shapes. In some embodiments, the shape of first glass 110 and second glass 120 changes from polyhedral at first closed end 112 and second closed end 122 to circular at first open end 113 and second open end 123. In some embodiments, including the embodiment shown in FIG. 1, first glass 110 and second glass 120 are substantially the same size and shape. In some embodiments, first glass 110 and second glass 120 are of dissimilar shape. First glass 110 and second glass 120 are formed in any shape consistent with a container from which a comestible beverage may be consumed, in some embodiments, and without any other limitation whatsoever with respect to shape.

In some embodiments, (not shown in the drawing figures), first side 111 and second side 121 are formed as a double-walled side containing a liquid or semi-liquid gel with a lower freezing temperature than water, such as liquids of semi-liquid gels used in many commercially available "freezer packs," sealed within and contained between the double walls. In such embodiments, double-barreled drinking container 100 may be frozen in the freezer prior to use, wherein the liquid or semi-liquid gel freezes and remains frozen for an extended time after double-barreled drinking container 100 is removed from the freezer and filled with a cool, liquid comestible. The liquid or semiliquid gel increases the overall thermal inertia of double-barreled drinking container 100, wherein the refrigeration temperature the liquid comestible contained within is maintained for a longer time period. In some embodiments, first glass 111, second glass 121 and a bridge 103 comprise a unitary body with a double-wall throughout first glass 111, second glass 121 and bridge 103. In some embodiments, only first glass 111 and second glass 121 comprise double-wall construction filled with liquid or semi-liquid gel while bridge 103 is not double walled or not filled with liquid or semi-liquid gel. Some non-limiting examples of a liquid or semi-liquid gel with a freezing point lower than water known in the art include hydroxyethyl cellulose, sodium polyacrylate, vinyl-coated silica, and other commercially available gels and liquids with similar thermal properties.

First glass 110 and second glass 120 are joined in a side-by-side configuration along the length of first glass 110 and second glass 120 at bridge 103. Bridge 103 functions to couple first glass 110 and second glass 120 together. Accordingly, in some embodiments, bridge 103 provides rigid support and bears a substantial portion of the weight when double-barreled beverage container 100 is lifted while filled with a comestible liquid for drinking. Bridge 103 rigidly couples first glass 110 to second glass 120. In some embodiments, first glass 110, second glass 120, and bridge 103 are a unitary body formed from a molded material, such as glass, polycarbonate, other moldable materials, and the like.

The components defining any double-barreled beverage container 100 may be formed of any of many different types of materials or combinations thereof that can readily be formed into shaped objects provided that the components selected are consistent with the intended operation of double-barreled beverage container 100. For example, the components may be formed of: glass, polymers such as thermoplastics (such as ABS, Fluoropolymers, Polyacetal, Polyamide; Polycarbonate, Polyethylene, Polysulfone, and/ or the like), thermosets (such as Epoxy, Phenolic Resin, Polyimide, Polyurethane, Silicone, and/or the like), any combination thereof, and/or other like materials; composites and/or other like materials; metals, such as titanium, copper, stainless steel, aluminum, any combination thereof, and/or other like materials; alloys, such as aluminum alloy, titanium alloy, copper alloy, any combination thereof, and/or other like materials; any other suitable material; and/or any combination thereof.

In some embodiments, first glass 110, second glass 120, and bridge 103 are formed as separate structures and later coupled using a coupling means, such as rivets, snaps, other fasteners, and the like; adhesives; annealing; and any other suitable coupling means to form double-barreled beverage container 100.

Furthermore, any or all of components of any double-barreled beverage container may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), any combination thereof, and/or the like for example, depending on, among other considerations, the particular material forming the components. Other possible steps might include polishing, powder coating, and/or painting the components for example.

FIG. 1 also shows a plane "A." Plane A is the plane that passes through double-barreled beverage container 100 parallel to the long axis of beverage container 100, bisecting first glass 110, second glass 120, and bridge 103 of double-barreled beverage container 100 into two symmetrical halves.

Figure 2A:
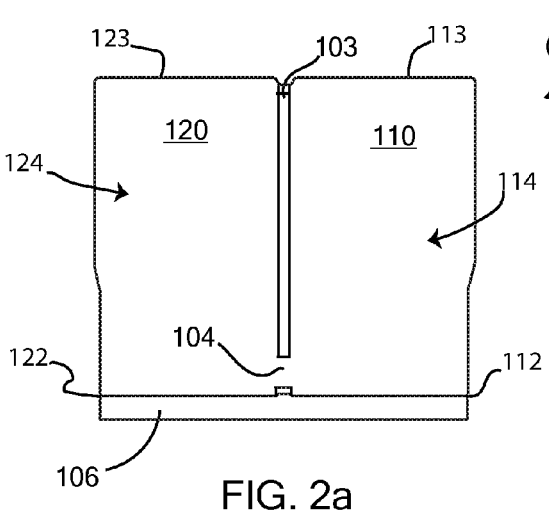
FIGS. 2*a-c* are cross-sectional views of double-barreled beverage containers through plane "A"
Figure 2B:
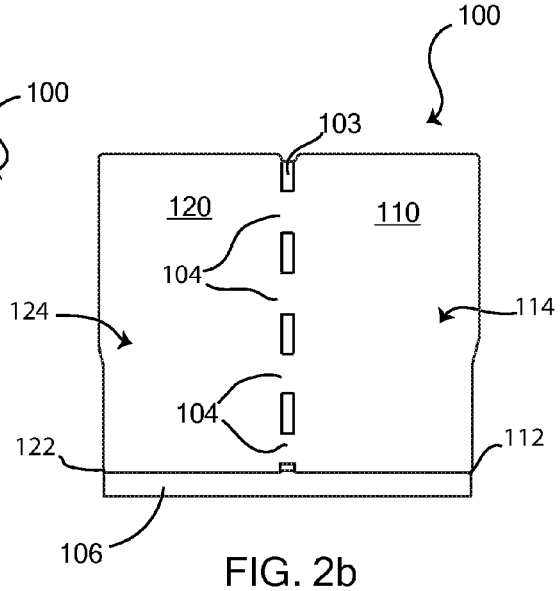
Figure 2C:
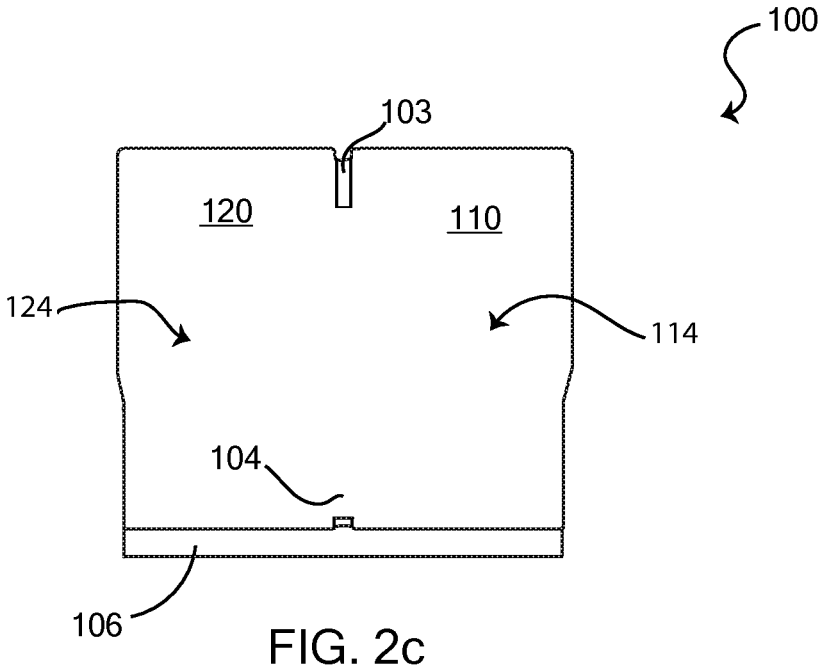
Figure 3A:
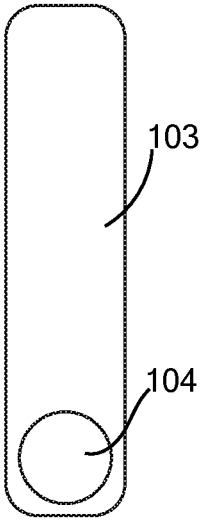
FIGS. 3*a-c* are side-detail views of a bridge of double-barreled beverage containers bearing a flow hole.
Figure 3B:
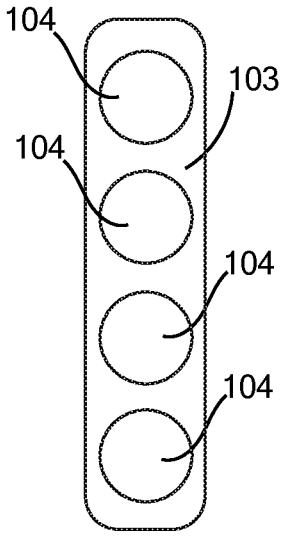
Figure 3C:
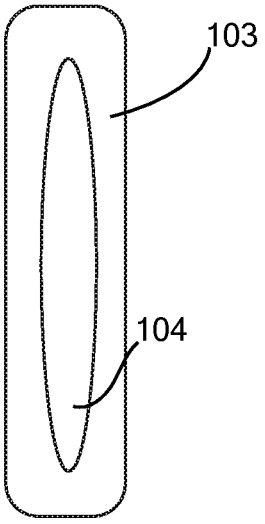

FIGS. 2*a-c* are cross-sectional views of embodiments of a double-barreled beverage container 100 through plane "A." FIGS. 3*a-c* are side detail views of bridge 103 of double-barreled beverage container 100. FIGS. 2*a-c* and FIGS. 3*a-c* show a flow hole 104. FIGS. 2*a-c* show the relationship between first glass 110, second glass 120, bridge 103, and flow hole 104. Bridge 103 comprises a flow hole 104, as shown in FIGS. 2*a-c* and FIGS. 3*a-c*.

Flow hole 104 is a communication between first glass 110 and second glass 120 through bridge 103, and allows the fluid level of a comestible or other liquid contained in double-barreled beverage container 100 to equilibrate between first interior volume 114 and second interior volume 124. Thus, when a user tips double-barreled beverage container 100 to drink from either first glass 110 or second glass 120, the comestible freely passes from the upper glass to the lower glass, from which the user is drinking. When a user tips double-barreled drinking container 100 to drink from either first glass 110 or second glass 120, fluid levels of the liquid comestible in first glass 110 and second glass 120 continuously equilibrate to remain the same because gravity causes constant free-flow of liquid between first glass 110 and second glass 120 through flow hole 104. Flow hole 104 is located proximate to first open end 113 of first glass 110 and second open end 123 of second glass 120, as shown by FIG. 2*a*. This example location of flow hole 104 allows a complete or near-complete emptying of first glass 110 when a user is drinking from second glass 120 and vice-versa. In some embodiments, the cross-sectional shape of flow hole 104 is a circle (such as in the embodiment shown in FIG. 3*a*). In some embodiments, flow hole 104 is shaped as an elongate ellipse with a long axis generally parallel to a long axis of bridge 103. For example, in some embodiments wherein first glass 110 and second glass 120 are shot glasses (not shown), flow hole 104 is an elongate ellipse with a long axis generally parallel to the long axis of bridge 103. In this example, and some other embodiments wherein a liquid comestible is rapidly consumed from beverage container 100, such as when "drinking a shot," flow hole 104 necessarily comprises a larger portion of the length of bridge 104 than in some other embodiments wherein the liquid comestible is consumed more gradually, such as wherein first glass 110 and second glass 120 contain beer, for example. An example of an embodiments of double-barreled beverage container 100 wherein bridge 103 comprises a relatively large, elongate flow-hole 104 is shown in FIG. 2*c*.

In the example embodiment shown in FIG. 2*a*, and in some other embodiments, bridge 103 comprises a single flow-hole 104. In some embodiments, such as the example embodiments shown in FIG. 2*b*, bridge 103 comprises a plurality of flow holes 104. Bridge 103 may comprise one or any number of flow holes 104. Flow hole 104 may be round, ellipsoid, polygonal, irregular, or any shape or combination of shapes and, number, and sizes, without limitation.

FIG. 2 also shows a base 106, present in some embodiments. In some embodiments, base 106 is coupled to first glass 110, second glass 120, and bridge 103. Base 106, if present in a particular embodiment, functions as a platform upon which double-barreled beverage container 100 rests when not being lifted or held by a user. In some embodiments (not shown), base 106 is configured in a shape to insert into a drinking container receptacle, such as vehicle cup-holder, for example. In some embodiments (not shown), base 106 is shaped to allow insertion into a traditional cup-holder, such as the cup-holders found in sports stadiums, movie theaters, and the like. Base 106 may be formed as a unitary body with first glass 110, second glass 120, and bridge 104, in some embodiments. In some embodiments, base 106 is a separate component of double-barreled beverage container 100 which is coupled to first glass 110, second glass 120, and bridge 103 during formation of double-barreled beverage container 100. Any suitable method known in the art of coupling base 106 to first glass 110 and second glass 120 may be used, such as molding as a unitary body; adhesives, such as epoxies; annealing; snapping together surface features of base 106, first glass 110, second glass 120, and bridge 103; and the like, without limitation.

FIGS. 3*a-c* are side-detail views of a bridge of double-barreled beverage containers bearing a flow hole. Various example embodiments are shown, wherein bridge 103 comprises one or more flow holes 104 of some example shapes. As already mentioned above, the examples shown by FIGS. 3*a-c* and described herein are by way of example only and in no way meant to be limiting.

Figure 4:
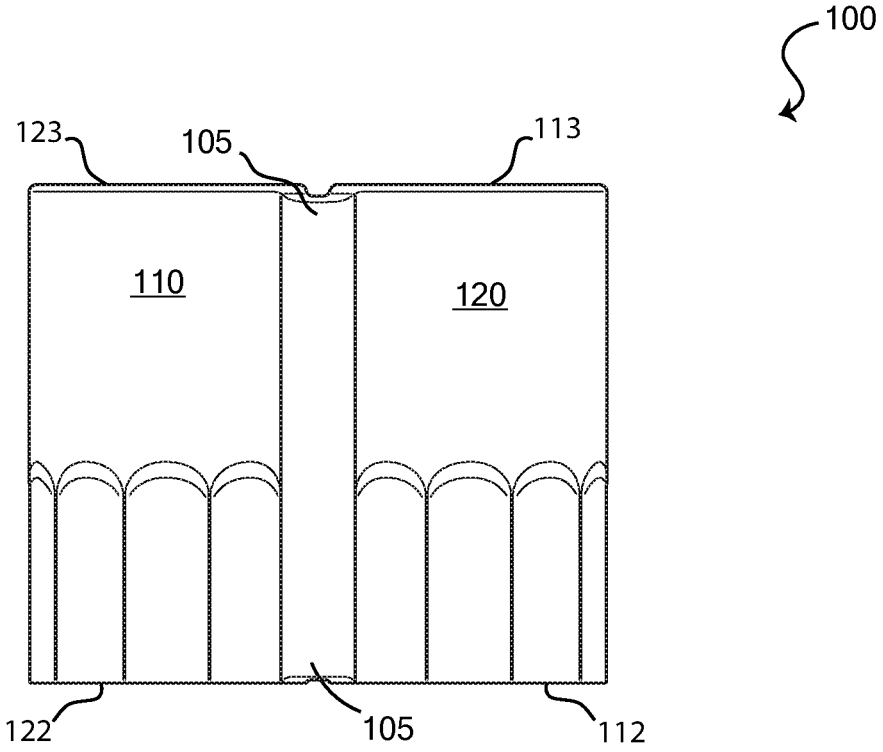
FIG. 4 is a rear view of a double-barreled beverage container.

FIG. 4 is a rear view of double-barreled beverage container 100. In additional to the aforementioned elements of beverage container 100, FIG. 4 shows a handle 105. Handle 105 is present in some embodiments of double-barreled beverage container 100. In some embodiments, handle 105 is coupled to bridge 103. In some embodiments (See FIG. 6*b* and FIG. 7*b*) two handles 105 are coupled opposite one another to bridge 103. In some embodiments (not shown) handle 105 is coupled directly to first glass 110, second glass 120, or one handle 105 is coupled each to first glass 110 and second glass 120. It is anticipated that many variations for placement of handle 105 on double-barreled beverage container 100 are possible, therefore, the aforementioned examples are not meant to be limiting. Handle 105 is, in some embodiments shaped in a closed-loop similar to a traditional handle. A larger handle is desirable, in some embodiments, such that a user may safely and comfortably lift and hold double-barreled beverage container 100 filled with a twice the volume of comestible liquid when compared to other drinking containers, such as a traditional beer mug. In some embodiments, handle 105 is formed as a unitary body with bridge 103. In some embodiments, handle 105 is formed as a unitary body with first glass 110, second glass 120 and bridge 103. In some embodiments, handle 105 is formed from and comprises the same material as bridge 103, first glass 100, or second glass 120. Alternatively, handle 105 comprises a different substance from first glass 110, second glass 102, or bridge 103. Examples of materials used to form handle 105 different from other elements of double-barreled drinking container 100 include rubber, either synthetic or natural; neoprene; plastics with a molded or rough-finished surface; and the like; without limitation.

Figure 5:
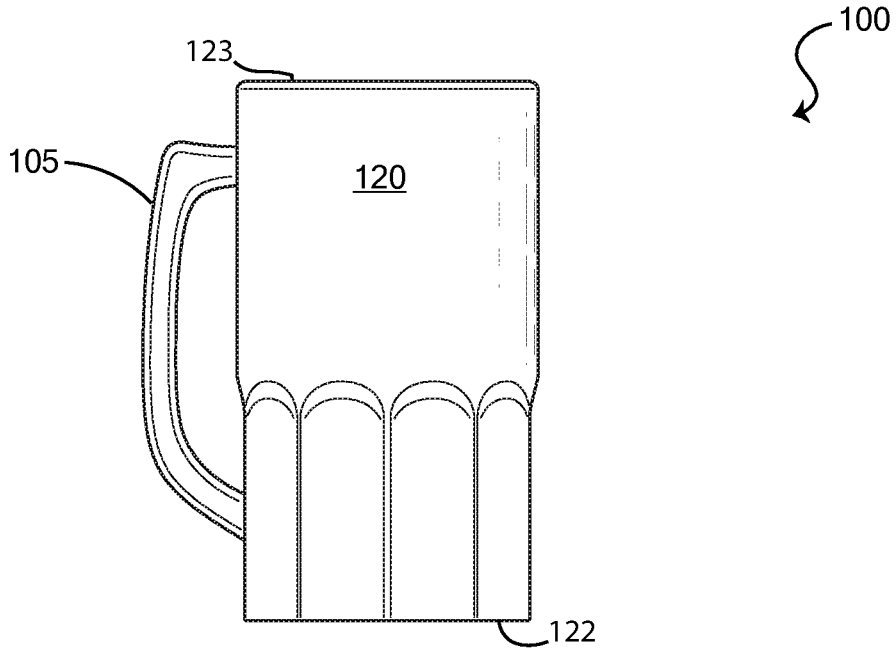
FIG. 5 is a right-side view of a double-barreled beverage container.
Figure 6A:
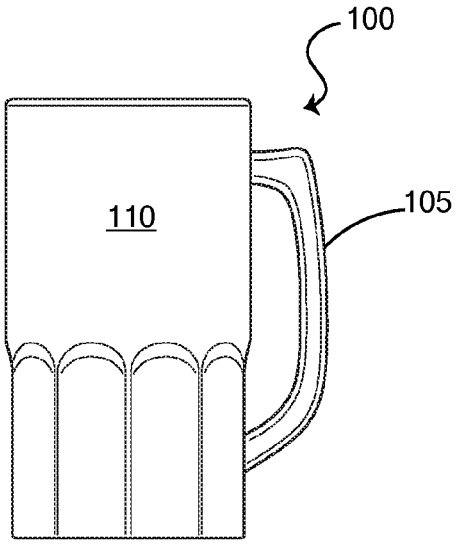
FIGS. 6*a-b* are left-side views of double-barreled beverage containers.
Figure 6B:
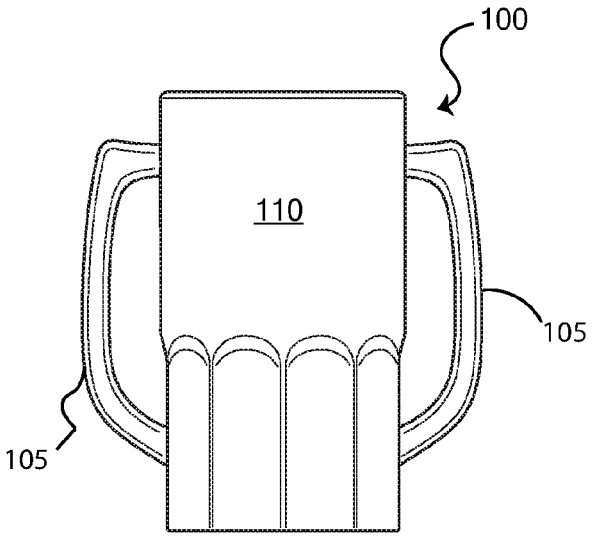

FIG. 5 is a right-side view of double-barreled beverage container 100 and FIGS. 6*a-b* are left-side views of double-barreled beverage container 100. FIG. 5 and FIGS. 6*a-b* show an example embodiment of double-barreled beverage container 100 demonstrating each of second glass 120 and first glass 110 in relation to handle(s) 105. Embodiments of double-barreled beverage container 100 comprising two handles 105, such as the embodiments shown in FIG. 6*b* and FIG. 7*b*, provide means for a user to lift and hold beverage container 100 with both hands. Using both hands to carry or drink from double-barreled beverage container 100 increases the safety and comfort of holding and drinking from beverage container 100, and may decrease the risk of spillage. Additionally, a means for use of both hands, such as two handles 105 located generally opposite each other on double-barreled beverage container 100 allows a user to grasp beverage container 100 simultaneously with both hands and be a "two fisted drinker."

Figure 7A:
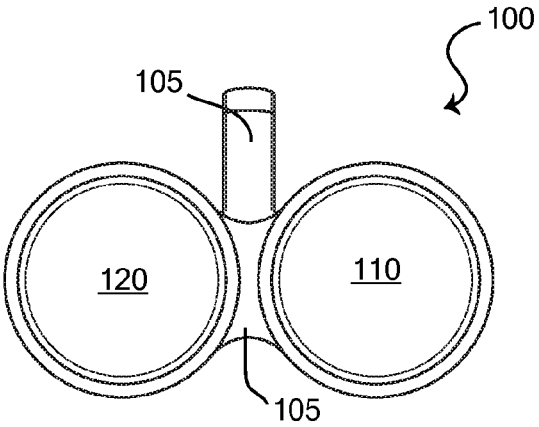
FIGS. 7*a-b* are top views of a double-barreled beverage container.
Figure 7B:
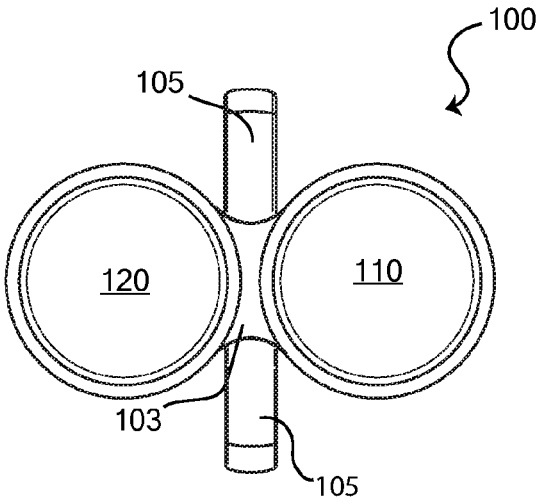

FIGS. 7*a-b* are top views of double-barreled beverage container 100. As shown by the figures, first glass 110 and second glass 120 are roughly symmetrical and equivalent. This is not meant to be limiting. First glass 110 and second glass 120 may be of different shapes and forms. First glass 110 and second glass 120, however, necessarily have a generally similar capacity, although not necessarily the same capacity, such that a fluid placed into the larger of either first glass 110 or second glass 120 will not overflow from the smaller of either first glass 110 or second glass 120.

Figure 8:
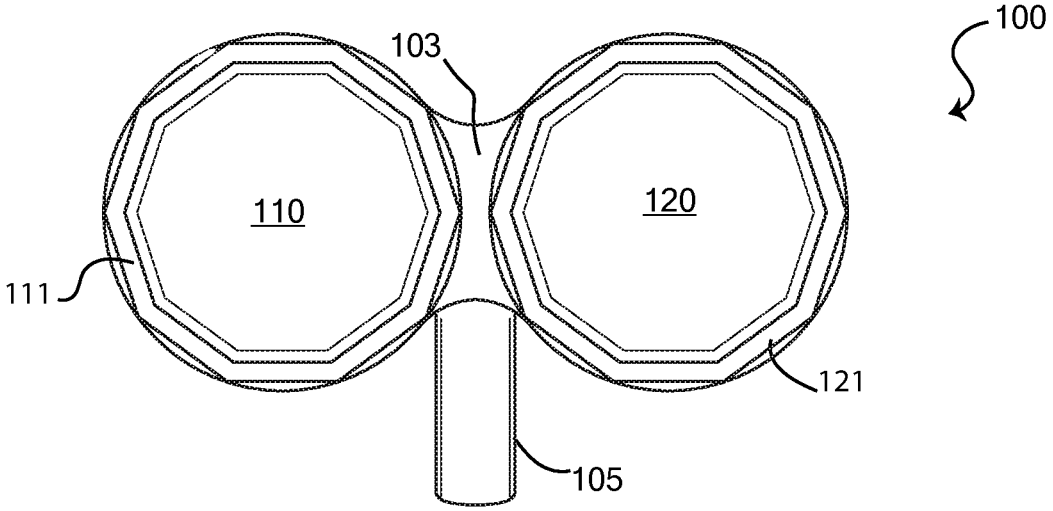
FIG. 8 is a bottom view of a double-barreled beverage container.

FIG. 8 is a bottom view of double-barreled beverage container 100. In the example embodiment shown by FIGS. 7*a-b* and FIG. 8, bridge 103 couples to first glass 110 and second glass 120 along an arc-length of the circumference or first glass 110 and second glass 120. This strengthens the coupling between first glass 110 and second glass 120, according to the distance of the arc-length of the coupled circumference. Also shown is the coupling of handle 105, in this and some other embodiments wherein double-barreled beverage container 100 comprises handle 105, to bridge 103. Additionally, handle 105 is coupled to bridge 103, first glass 110, or second glass 120, in some embodiments. In some embodiments, a plurality of handles 105 is coupled to one or more than one of bridge 103, first glass 110, and second glass 120.

Figure 9:
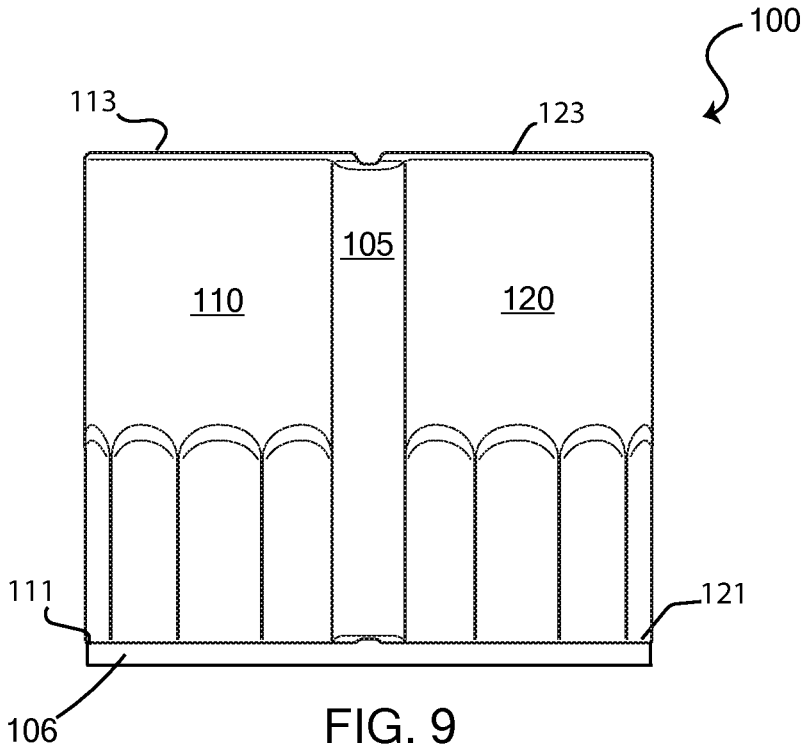
FIG. 9 is a rear view of a double-barreled beverage container comprising a base.

FIG. 9 is a front view of double-barreled beverage container 100. FIG. 9 shows an example embodiment wherein double-barreled beverage container 100 comprises base 106. Base 106 is a shape of the generally the same profile of closed first open end 113, closed second open end 123, and base 103, in some embodiments, however this is not meant to be limiting. In some embodiments, base 103 is a larger profile to create added stability when double-barreled drinking container 100 rests on a relatively flat surface, such as a counter or a table. Stability is important to avoid spills and other accidents, in light of the greatly increased volumetric capacity of double-barreled beverage container 100 versus a traditional beverage container. Moreover, base 106, particularly wherein base 106 comprises a larger profile and, therefore, providing more stability, first side 111 and second side 121 of first glass 110 and second glass 102 respectively may be longer, further increasing the volumetric capacity of double-barreled beverage container 100. Base 106, along with bridge 103, additionally couples first glass 110 to second glass 120, in some embodiments.

Base 106 is formed as a unitary body with first glass 110, second glass 120, and bridge 103, in some embodiments. In some embodiments, base 106 is formed separately and coupled to first closed end 112 and second closed end 122 using interlocking surface features of base 106, first closed end 113 and second closed end 123. Adhesives, such as glues or epoxies; or other suitable means of attachment are used, in some embodiments. In some embodiments, base 106 is reversibly coupled to first glass 110 and second glass 102 such that base 106 may be easily replaced, or so that bases 106 of different colors, designs, or shapes may be interchanged on single double-barreled beverage container 100.

Figure 10A:
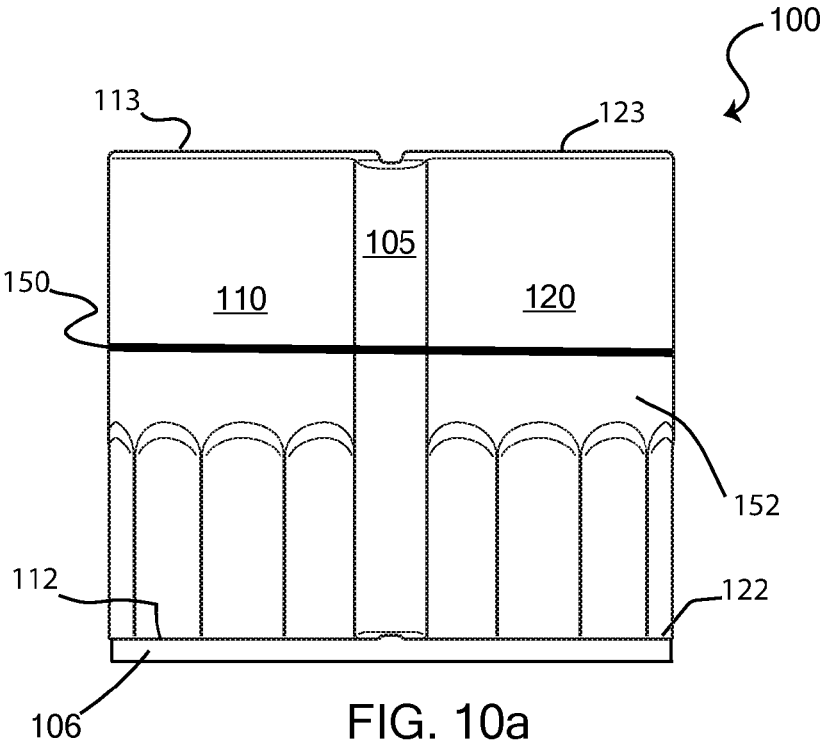
FIGS. 10*a-b* are rear views of a double-barreled beverage container partially filled with a fluid.
Figure 10B:
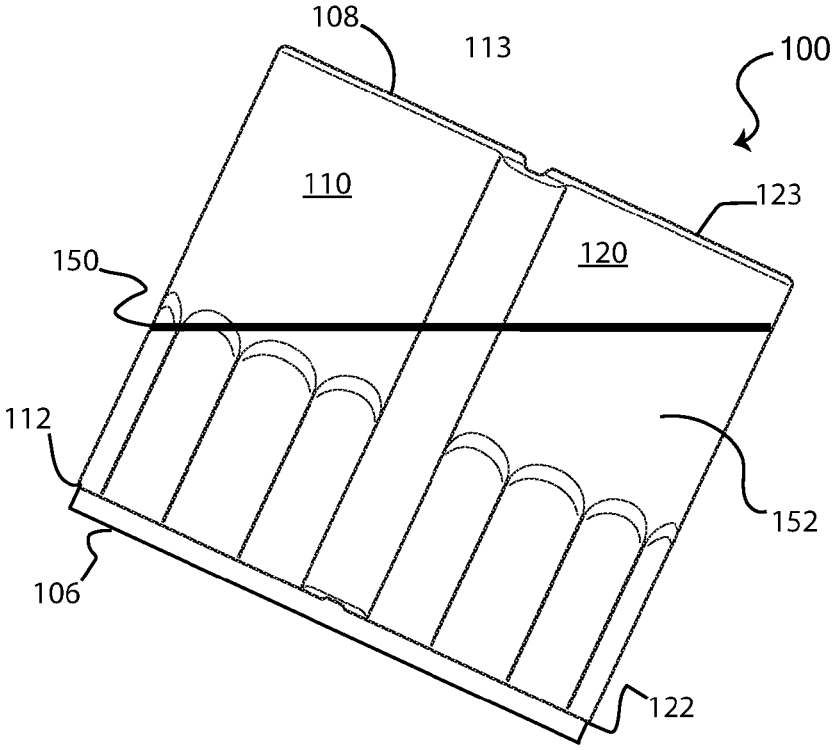

FIGS. 10*a-b* are rear views of a double-barreled beverage container partially filled with a fluid 152. FIG. 10*a* shows double-barreled beverage container 100 in an upright position and FIG. 10*b* shows double barreled beverage container 100 in a tipped position. As seen in these figures, and already described herein above, a fluid level 150 of fluid 152 partially filling double-barreled beverage container 100 remains horizontal regardless of the position of container 100, because fluid 152 flows freely between first glass 110 and second glass 120 through flow hole 104 (not shown in FIGS. 10*a-b*) in response to gravity. Wherein fluid 152 is a comestible beverage, a user of double-barreled beverage container 100 may consume all of fluid 152 contained within both first glass 110 and second glass 120 of container 100 by tipping container 100 and drinking from one of either first glass 110 or second glass 120.

Figure 11:
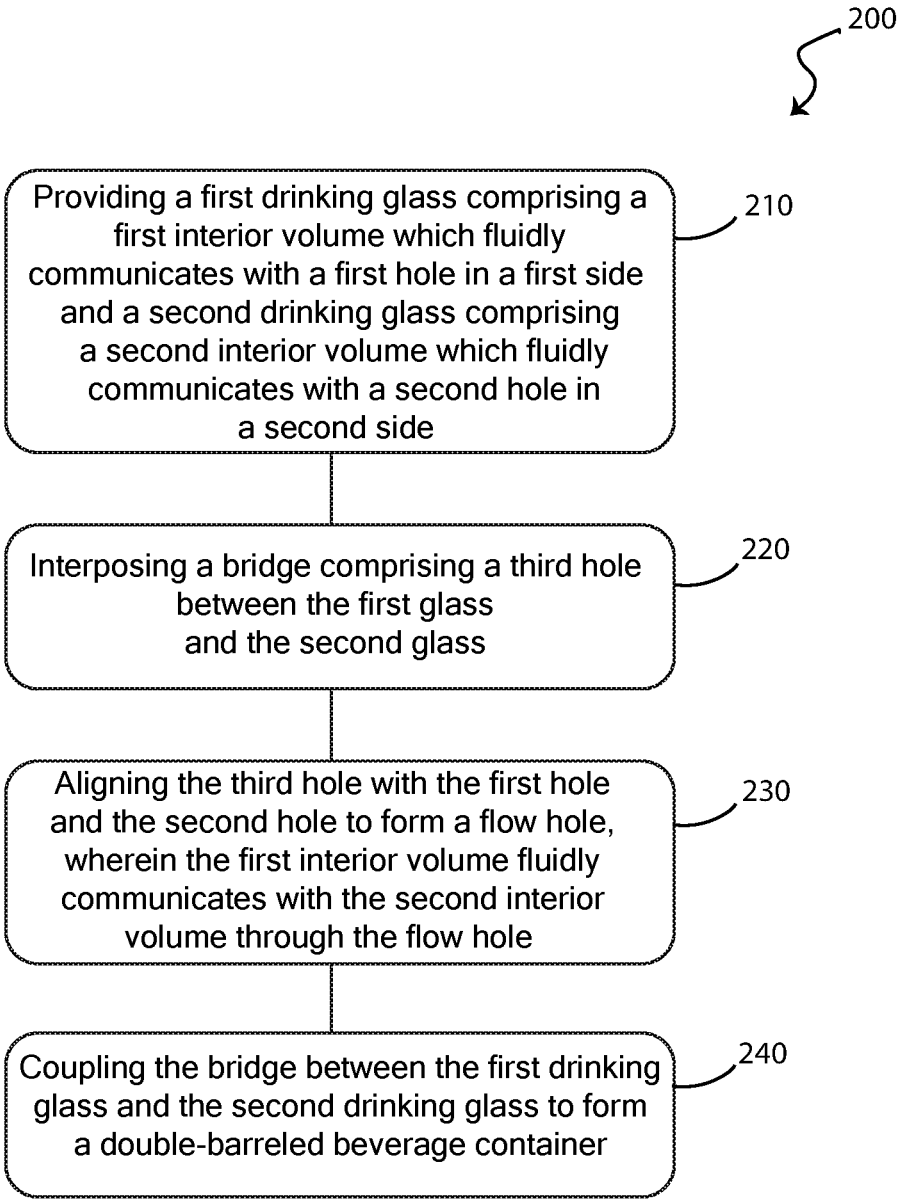
FIG. 11 is a flowchart diagramming steps of a method of forming a double-barreled beverage container.

FIG. 11 is a flowchart diagramming steps of a method 200 of forming a double-barreled beverage container. Method 200 comprises a providing step 210, an interposing step 220, an aligning step 230, and a coupling step 240.

Providing step 210 comprises providing a first drinking glass comprising a first interior volume which fluidly communicates with a first hole in a first side and a second drinking glass comprising a second interior volume which fluidly communicates with a second hole in a second side. The first drinking glass and the second drinking glass may be of any shape, size, and form, without limitation. Some examples include beer mugs, shot glasses, drink cups, water glasses, and the like.

Interposing step 220 comprises interposing a bridge comprising a third hole between the first drinking glass and the second drinking glass. The bridge is of a shape to conform to the surface features of the first drinking glass and the second drinking glass in the general region of the first hole and the second hole, in some embodiments.

Aligning step 230 comprises aligning the third hole with the first hole and the second hole to form a flow hole, wherein the first interior volume fluidly communicates with the second interior volume through the flow hole. Aligning step 230 establishes fluid communication between the first and second interior volumes of the first and second drinking glasses respectively.

Coupling step 240 comprises coupling the bridge between the first drinking glass and the second drinking glass to form a double-barreled beverage container. The bridge serves both to couple the first glass to the second glass and to provide additional rigidity to the double-barreled drinking container. Means of coupling include, but are not limited to, injection molding the first glass, the second glass, and the bridge as a unitary body, annealing, fastening, snapping together complementary surface features, and the like.

In some embodiments, method 200 additionally comprises a step of coupling a handle to the double barreled beverage container. Means of coupling include, but are not limited to, injection molding the handle as a unitary body with the bridge, the first drinking glass, the second drinking glass, or any combination thereof; annealing; fastening; snapping together complementary surface features; and the like. In some embodiments, the handle is coupled to the bridge. In some embodiments, the handle is coupled to the first drinking glass. In some embodiments, the handle is coupled to the bridge and a second handle is coupled to the bridge opposite the first handle. In some embodiments, the first handle is coupled to the first drinking glass and a second handle is coupled to the second drinking glass opposite the first handle. In some embodiments, this step comprises coupling a plurality of handles to the double-barreled beverage container.

In some embodiments, method 200 additionally comprises a step coupling a base to the first drinking glass and the second drinking glass.

Figure 12:
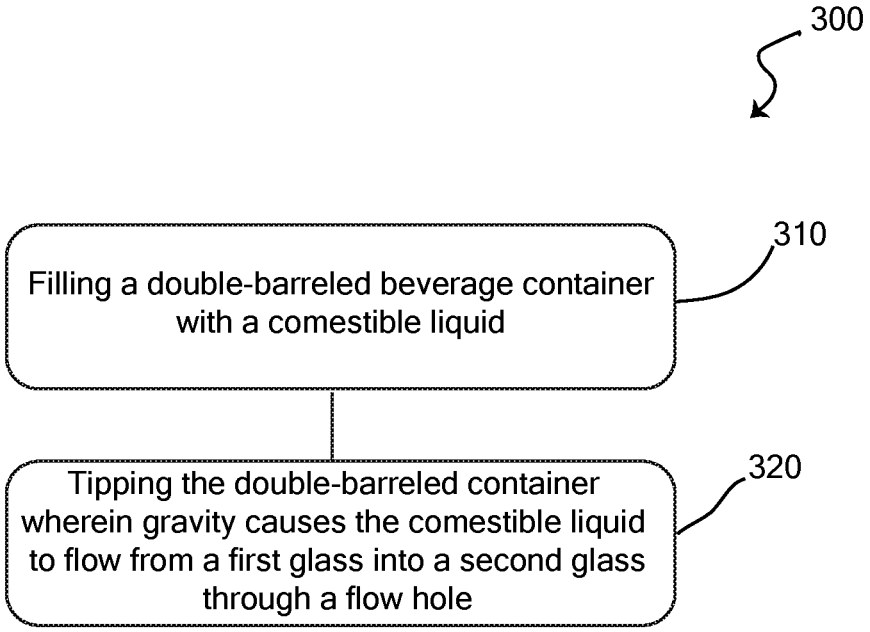
FIG. 12 is a flowchart diagramming steps of a method of using a double-barreled beverage container.

FIG. 12 is a flowchart diagramming steps of a method 300 of using a double-barreled beverage container. Method 300 comprises a filling step 310 and a tipping step 320.

Filling step 310 comprises filling a double-barreled beverage container with a comestible liquid. In some embodiments, the comestible liquid comprises a yeast-fermented beverage, such as beer or mead, for example.

Tipping step 320 comprises tipping the double-barreled beverage container wherein gravity causes the liquid comestible to flow from a first glass into a second glass through a flow hole. Because the flow hole or a plurality of flow holes allows the comestible liquid to flow freely between a first drinking glass and a second drinking glass of the double-barreled beverage container, the fluid level of the comestible liquid remains equal between the first drinking glass as the second drinking glass, allowing the user to consume around twice the volume of comestible from the double-barreled beverage container as a conventional drinking glass without pouring out or otherwise spilling comestible from either drinking glass of the double-barreled beverage container. In some embodiments, the method further comprises a step grasping a handle of the double-barreled beverage container. In some embodiments, the method further comprises a step simultaneously grasping two handles of the double-barreled beverage container.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

What is claimed is:

1. A double-barreled beverage container comprising:

a first glass comprising:

a first interior volume bounded by a first side, a first closed end bottom, and a first open end;

a second glass comprising:

a second interior volume bounded by a second side, a second closed end bottom, and a second open end; and a bridge rigidly coupled between the first side and the second side and comprising a flow hole proximate to the first closed end bottom of the first glass and the second closed end bottom of the second glass, wherein only the flow hole fluidly couples the first interior volume and the second interior volume, and wherein the first glass, the second glass and the bridge are formed as a unitary body.

2. The double-barreled beverage container of claim 1, further comprising a handle coupled to the bridge.

3. The double-barreled beverage container of claim 2, further comprising a second handle coupled to the bridge opposite the first handle.

4. The double-barreled beverage container of claim 1, further comprising a handle coupled to the first side.

5. The double-barreled beverage container of claim 2, further comprising a handle coupled to the second side.

6. The double-barreled beverage container of claim 1, further comprising a handle coupled to the first side and a handle coupled to the second side.

7. The double-barreled beverage container of claim 1, further comprising a base coupled to the first closed end and the second closed end.

8. The double-barreled beverage container of claim 1, comprising a plurality of flow holes.

9. A method of forming a double-barreled unitary body beverage container comprising the steps of:

providing a first drinking glass comprising a first interior volume which fluidly communicates with a first hole proximate to a bottom of the first glass in a first side and a second drinking glass comprising a second interior volume which fluidly communicates with a second hole proximate to a bottom of the second glass in a second side;

rigidly interposing a bridge comprising a third hole proximate to a bottom of the bridge between the first glass and the second glass;

aligning the third hole with the first hole and the second hole to form a flow hole, wherein the first interior volume fluidly communicates with the second interior volume only through the flow hole; and coupling the bridge between the first drinking glass and the second drinking glass to form a double-barreled beverage container.

10. The method of claim 9, further comprising coupling a handle to the double-barreled beverage container.

11. The method of claim 9, further comprising coupling a plurality of handles to the double-barreled beverage container.

12. The method of claim 10, wherein the handle is coupled to the bridge.

13. The method of claim 10, wherein the handle is coupled to the first drinking glass.

14. The method of claim 10, wherein a first handle is coupled to the bridge and a second handle is coupled to the bridge opposite the first handle.

15. The method of claim 10, wherein a first handle is coupled to the first drinking glass and a second handle is coupled to the second drinking glass opposite the first handle.

16. The method of claim 9, further comprising coupling a base to the first drinking glass and the second drinking glass.

17. A method of using a double-barreled unitary body beverage container comprising the steps of:

filling the double-barreled beverage container with a comestible liquid; and tipping the double-barreled beverage container wherein gravity causes the comestible liquid to flow freely from a first glass of the double-barreled beverage container into a second glass alongside of and joined together with the first glass of the double barreled beverage container at a rigid bridge, only through a flow hole near the bottom of the bridge allowing fluid levels of the comestible liquid in the first glass and the second glass to continuously equilibrate, wherein all of the comestible liquid contained within both the first glass and the second glass may be consumed at once by drinking from one of either the first glass or the second glass.

18. The method of claim 17, further comprising a step grasping a handle of the double-barreled beverage container.

19. The method of claim 17, further comprising a step simultaneously grasping two handles of the double-barreled beverage container.

20. The method of claim 17, wherein the comestible liquid comprises a yeast-fermented beverage.

* * * * *